United States Patent [19]

Foit

[11] Patent Number: 4,949,854

[45] Date of Patent: Aug. 21, 1990

[54] ANTI-SWAY CRANE REEVING APPARATUS

[75] Inventor: Vilem Foit, Greenfield, Wis.

[73] Assignee: Harnischfeger Corporation, Brookfield, Wis.

[21] Appl. No.: 281,719

[22] Filed: Dec. 9, 1988

[51] Int. Cl.[5] ..... B66C 13/06

[52] U.S. Cl. ..... 212/147; 212/148

[58] Field of Search ..... 212/146, 147, 148, 213

[56] References Cited

U.S. PATENT DOCUMENTS 3,945,503 3/1976 Cooper ..... 212/147

FOREIGN PATENT DOCUMENTS 97909 4/1964 Denmark ..... 212/147

*Primary Examiner*—Sherman D. Basinger
*Assistant Examiner*—Thomas J. Brahan
*Attorney, Agent, or Firm*—Richard C. Ruppin

[57] ABSTRACT

An anti-sway crane reeving apparatus is disclosed in which a reeving apparatus is connected between an overhead frame carried by a crane, winding drum means mounted on the frame, and a lifting beam positioned below the frame from which a load carrying means is suspended. The reeving apparatus includes a plurality of upper spaced-apart sheaves affixed to the overhead frame and a plurality of lower spaced-apart sheaves affixed to the lifting beam. Each of the lower sheaves has first and second grooves. A rope means is affixed to the drum means and overhead frame and extends between the drum means and the lower sheaves and between the upper and lower sheaves. The rope means includes a plurality of pairs of first and second ropes having a reeving path extending to and wrapping in the same direction around the first and second grooves of each of the lower sheaves. Each pair of first and second ropes extends from the lower sheaves in directions transverse to the axis of the sheaves and away from each other relative to the vertical. The ropes wrapping each lower sheave are under tension and in friction engagement with the lower sheave around which they wrap. They thus apply friction forces to the lower sheaves and lifting beam which opposes swaying forces on the sheave and lifting beam.

18 Claims, 2 Drawing Sheets

ANTI-SWAY CRANE REEVING APPARATUS

FIELD OF THE INVENTION

This invention relates to an anti-sway crane reeving apparatus and, in particular, to a reeving apparatus in which a load lifting means is suspended from a lifting beam and the reeving apparatus is connected between the lifting beam, an overhead frame carried by the crane, and winding drum means mounted on the frame.

DESCRIPTION OF THE PRIOR ART

In the current crane designs, there is an emphasis on high capacity which has been attained by increasing the travel speed of the crane upon its tracks and increasing the speed of the load carrying trolley suspended from the frame of the crane. In addition, lifting heights have been raised to thereby increase the amount of material which the crane can span. However, these high speeds and high lifts increase swaying problems of the load lifting means and the load carried by the lifting means which are suspended by a reeving arrangement from the trolley of the crane. During acceleration of the crane on its rails and acceleration of the trolley on its tracks on the frame, and particularly during rapid stopping of the crane frame or the trolley, the load carrying means and load suspended from the reeving is subject to swaying in directions parallel to the movement of the crane frame and the trolley. A high lift ability and consequent long ropes of the reeving increase the amplitude of the sway. Where the crane is of the gantry type such as a portal crane handling logs, the picking up the logs from the side of a pile or the carrying of an unbalanced log load can also result in rotational swaying of the load carrying means and log load which is exacerbated by long reeving ropes.

Reeving arrangements presently in use which are intended to prevent swaying generally have inadaquate stiffness to be effective in current fast and high cranes. The resulting swaying presents a danger of damage to the crane and to the load being carried by the crane. Also, substantial swaying results in a prolonged time cycle of the operation and in excessive rope wear since the ropes tend to jump out of the winding grooves of the crane hoist winding drum or rub against sheave flanges or rope guards due to excessive fleet angles.

SUMMARY OF THE INVENTION

It is a general object of this invention to provide a reeving apparatus in which the ropes have a reeving path providing a high degree of stiffness against swaying of the lifting beam, the load carrying means, and the load carried by the load carrying means. It is a further object of this invention to provide a reeving apparatus having a similar high degree of stiffness in both crane travel directions and directions transverse to crane travel.

The invention is carried out by providing a reeving apparatus connected to an overhead frame carried by a crane, winding drum means mounted on the frame, and a lifting beam positioned below the frame and which is subject to swaying forces and movement transverse to the vertical. A plurality of lower spaced-apart sheaves are affixed to the lifting beam. Each of the lower sheaves has first and second grooves. A rope means is affixed to the drum means and overhead frame and extends between the drum means and overhead frame and the lower sheaves. The rope means includes a plurality of first and second rope means having a reeving path extending from opposite direction relative to the vertical to and wrapping in the same direction around the first and second grooves of each of the lower sheaves. Friction forces are generated by each first and second rope means and one of the lower sheaves which dissipate energy of the swayng forces on the lifting beam.

The ropes wrapping each lower sheave are under tension and in friction enagagement with the lower sheave around which they wrap. They thus apply friction forces to the lower sheave and lifting beam which opposes swaying forces on the sheave and lifting beam. The tension forces applied by each first and second rope means to a sheave are in opposite directions and due to the wrapping of both ropes around a lower sheave, the energy of the sway is dissipated by friction between the ropes and sheave, thus significantly decreasing the amplitude of each succeeding sway movement. Since each pair of first and second ropes also extend to a lower sheave from opposite directions relative to the vertical, the forces on each lower sheave dissipating sway energy are of substantially the same level.

BRIEF DESCRIPTION OF THE DRAWINGS

Further objects and advantages of the invention will appear when taken in conjunction with the accompanying drawings, in which.

DETAILED DESCRIPTION OF THE INVENTION

Figure 1:
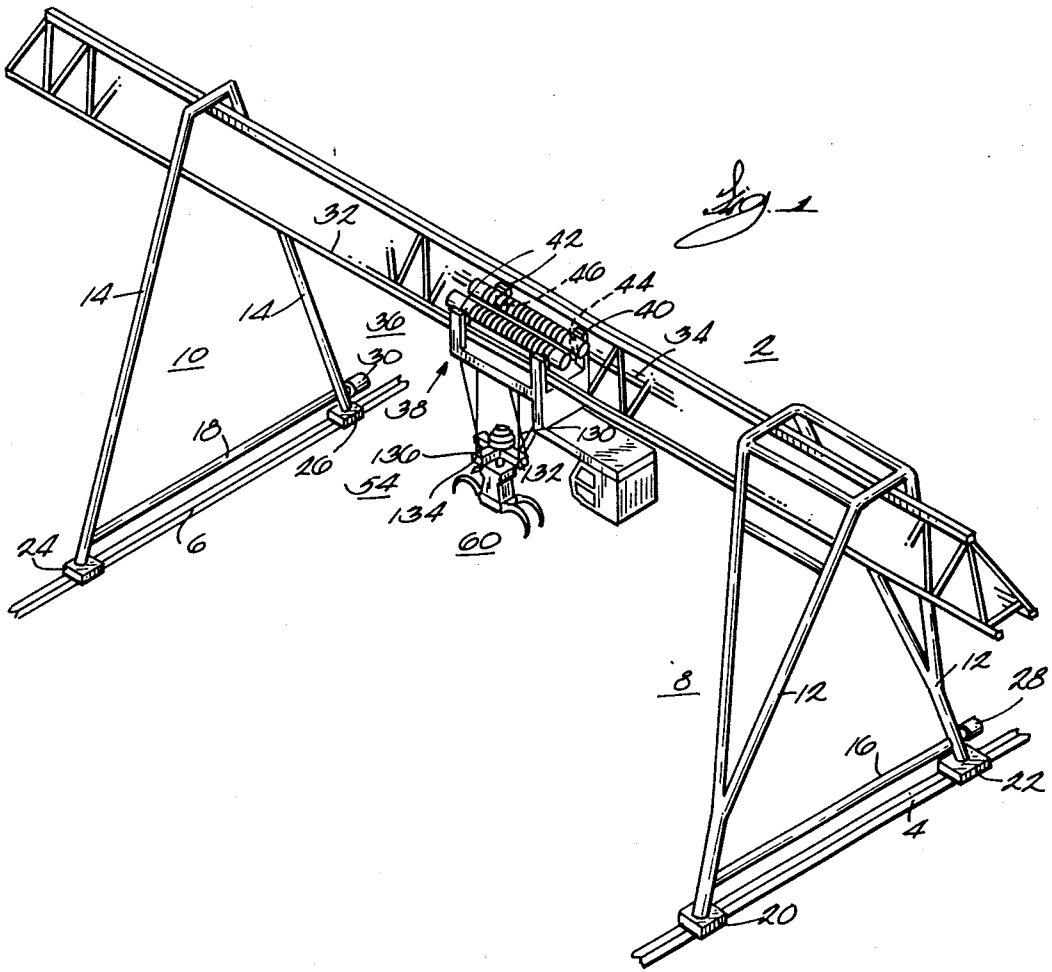
FIG. 1 is a perspective view of a portal crane incorporating the reeving apparatus of the invention.

Referring to FIG. 1 of the drawings, a crane of the portal type incorporating the invention is illustrated as having a frame 2 disposed generally horizontally and overlying two generally parallel rails 4 and 6, a trolley 36, and two spaced-apart legs 8 and 10 affixed to the frame 2. The rails 4 and 6 run through a storage area for material which is to be lifted and transported into and out of the storage area by the crane. The legs respectively include elongated members 12 and 14, lower bases 16 and 18, and spaced-apart wheel assemblies 20, 22, and 24, 26. The wheel assemblies 20, 22 engage and ride on the rail 4 and the wheel assemblies 24, 26 engage and ride on the rail 6. Wheel drive motors 28 and 30 are mounted on wheel assemblies 22 and 26. When driven by the motors 28 and 30 the portal crane travels along the rails 4 and 6 through the material storage area.

The frame 2 includes a pair of parallel tracks 32 and 34 on which a trolley 36 is carried for travel along the length of the frame 2. The trolley 36 includes an overhead frame 38 from which two pair of legs 40 and 42 extend upwardly and on which a pair of trolley support wheels 44 and 46 are mounted. The wheels 44 and 46 engage the tracks 32 and 34 support the trolley on the tracks. A trolley drive motor 48 is mounted on one of the pair of legs 42 and drives the wheels 46. A guard rail 50 is affixed to the trolley frame 38 for safety purposes during maintenance of the trolley and an operator cab 52 is also mounted on the trolley.

Figure 2:
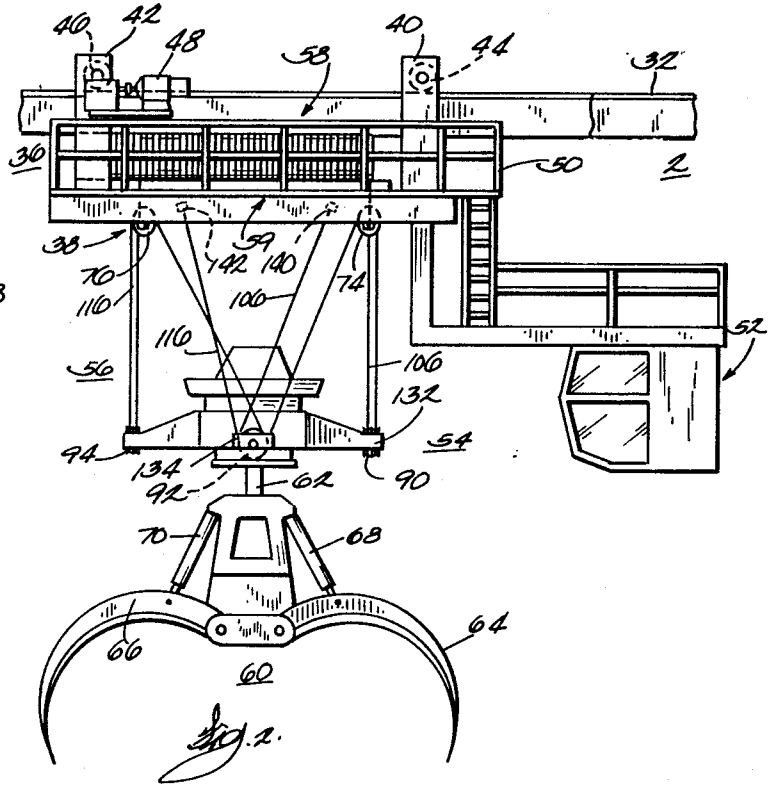
FIG. 2 illustrates a reeving apparatus according to the invention connected between an overhead trolley and a lifting beam from which a load carrying means is suspended.
Figure 3:
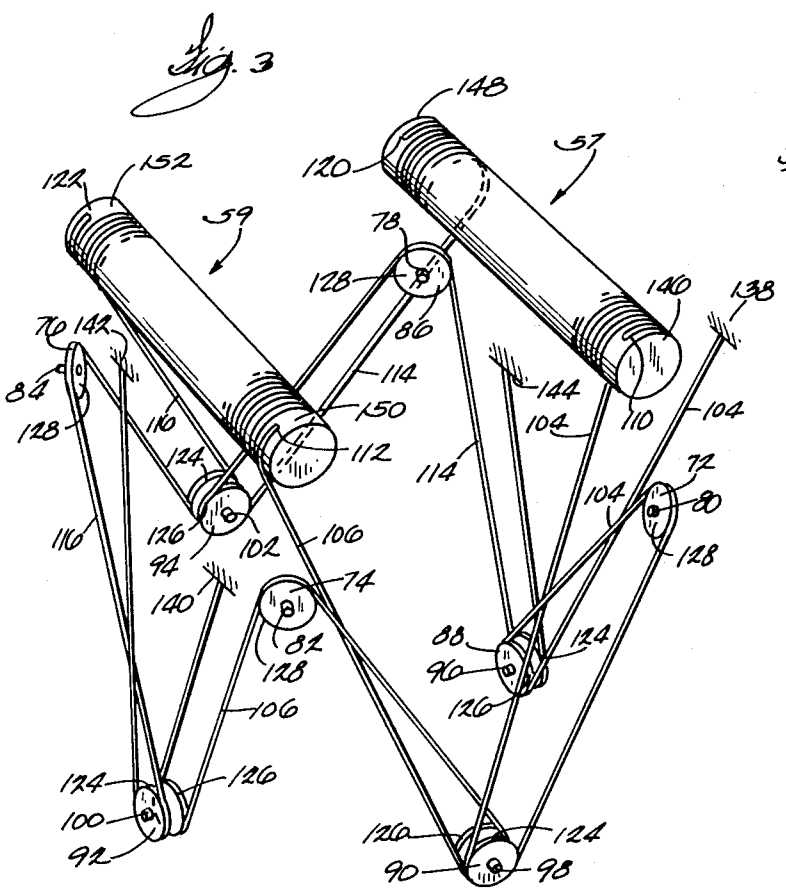
FIG. 3 is a simplified reeving diagram for the reeving apparatus.

With reference to FIG. 2, a lifting beam 54 is suspended from the trolley 36 by a reeving apparatus 56 which is affixed to the overhead frame 38 of the trolley, to winding drum means 58 comprising rotatable drums 57 and 59 mounted on the trolley frame 38, and to the lifting beam 54. As shown in FIG. 3, the drums 57 and 59 are spaced apart with their axes parallel to each other. A load carrying means such as a grapple 60 is rotatably connected to the lifting beams 54 by means of a double articulated joint 62 which permits pivoting of the grapple 60 about perpendicular and horizontal axes. The grapple 60 includes a pair of cylinders 68 and 70 which open and close a pair of load carrying arms 64 and 66 for grasping material to be lifted and transported by the crane. The operation of the grapple 60 including the load carrying arms 64 and 66, the winding drum means 58, the movement of the trolley 36, and the movement of the crane on the rails 4 and 6 is controlled from the operator cab 52 to lift, transport and set down material within the travel range of the crane and the trolley.

Figure 4:
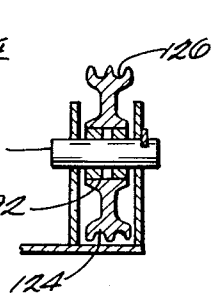
FIG. 4 is an end elevation view, partially in cross-section, of a double grooved sheave utilized in the reeving apparatus of the invention.

The reeving apparatus 56, as shown in FIGS. 2–4, includes upper spaced-apart, single-grooved, rotatable sheaves 72, 74, 76, and 78 which are affixed to the overhead trolley frame 38 by means of their mounting respectively on axles 80, 82, 84, and 86 which are attached to the frame 38. The groove in each of the upper sheaves is designated by the numeral 128. Lower spaced-apart, double-grooved, rotatable sheaves 88, 90, 92, and 94 are affixed to the lifting beam 54 by means of their being respectively mounted on axles 96, 98, 100, and 102 which are attached to the lifting beam 54. The axles 98 and 102 of the sheaves 90 and 94 are preferably parallel to the axes of drums 57 and 59 and the axles 96 and 100 of sheaves 88 and 92 are preferably transverse to the axes of drums 57 and 59. The lifting beam 54 is generally cruciform in shape and has ends 130, 132, 134 and 136 at which the lower sheaves 88, 90, 92 and 94 are respectively affixed. The grooves in each of the lower sheaves 88, 90, 92, and 94 are identified by the numerals 124 and 126. The rotatable drums 57 and 59 respectively have opposite ends 146, 148 and 150, 152. A pair of wire ropes 104 and 106 respectively wrap around the rotatable drum 57 at its end 146 and the drum 59 at its end 150. The rope 104 is affixed to the end 146 of drum 57 at location 110 and rope 106 is affixed to the end 150 of drum at location 112. Another pair of wire ropes 114 and 116 respectively wrap around the other end 148 of the drum 57 and end 152 of the drum 59. The rope 114 is affixed to the drum end 148 at location 120 and the rope 116 is affixed to the drum end 152 at location 122.

Each of the wire ropes 104, 106, 114 and 116 follow a separate path from the drums 57 or 59. The ropes 104 and 106 respectively extend downward from drums 57 and 59 to lower sheave 90. The ropes 114 and 116 respectively extend downward from drums 57 and 59 to lower sheave 94. As the rope 104 approaches the lower sheave 90 from the drum 57, it wraps around the lower sheave 90 in the groove 124 in a counter-clockwise rotative direction when viewed from the end 132 of the lifting beam 54. The rope 104 then extends from the sheave 90 in a direction toward an upper sheave 72 and wraps around the groove 128 in the sheave 72. From sheave 72, the rope 104 continues downward to lower sheave 88 and wraps around sheave 88 in groove 126 in a clockwise direction when viewed from the end 130 of the lifting beam 54. The rope 104 then extends upward from the sheave 88 and is affixed to the overhead frame 38 at anchoring location 138. The rope 106 follows another separate reeving path extending between the drum 59 and the lower sheave 90 and wraps around the lower sheave 90 in the groove 126 in the same counter-clockwise rotative direction of the sheave as the wrapping direction of the rope 104. The ropes 104 and 106 thus approach the lower sheave 90 from locations at the drums 57 and 59 which are spaced apart transversely to the axis of the sheave 90. However, the rope 106 extends from the lower sheave 90 in an opposite direction than the path of extension of rope 104 relative to the vertical and toward the upper sheave 74. The ropes 104 and 106 thus extend from the lower sheave 90 to the locations of sheaves 72 and 74 which are in opposite directions from sheave 90 relative to the vertical and are spaced apart transversely to the axis of the sheave 90. The rope 106 wraps around the sheave 74 in its groove 128 and then extends downwardly to the lower sheave 92. At the lower sheave 92, the rope 106 wraps around the sheave 88 in a groove 124 in a clockwise direction when viewed from the end 130 of the lifting beam 54. The rope 106 then extends upward from the sheave 88 and is attached to the frame 38 at anchor location 140.

The ropes 114 and 116 respectively follow separate paths around sheaves 94, 78, 88, 76, and 92 which are respectively similar to the paths of ropes 104 and 106 as shown in FIG. 3. At lower sheave 88, the rope 114 wraps around the sheave in a groove 124 in the same clockwise rotative direction as the wrapping of rope 104 around sheave 88, when viewed from the end 136 of lifting beam 54, and extends upward and is affixed to frame 38 at anchor location 144. However, the ropes 104 and 114 approach the lower sheave 88 from locations at sheaves 72 and 78 which are in opposite directions from lower sheave 88 relative to the vertical and are spaced apart transversely to the axis of the sheave 88. The ropes 104 and 114 also extend from the lower sheave 88 to the anchor locations 138 and 144 which are in opposite directions from sheave 88 relative to the vertical and are spaced apart transversely to the axis of the sheave 88 and generally in the direction of travel of the trolley 36 on the tracks 32 and 34. At lower sheave 92, the rope 116 wraps around the sheave in a groove 124 in the same clockwise rotative direction as the wrappings of rope 106 around sheave 92 and extends upward and is affixed to frame 38 at anchor location 142. However, the ropes 106 and 116 approach the lower sheaves 92 from locations at sheaves 74 and 76 which are in opposite directions from lower sheave 92 relative to the vertical and are spaced apart transversely to the axis of the sheave 92. The ropes 106 and 116 also extend from the lower sheave 92 to the anchor locations 140 and 142 which are in opposite directions from sheave 92 relative to the vertical and are spaced apart transversely to the axis of the sheave 92 and generally in the direction of travel of the trolley 36 on the tracks 32 and 34. At lower sheave 94, the ropes 114 and 116 wrap around sheave 94 respectively in grooves 126 and 124 in the same counter-clockwise direction when viewed from the end 136 of the lifting beam. However, the rope 114 extends upward at an angle relative to the vertical toward upper sheave 78 and the rope 116 extends upward in an opposite direction at an angle from the vertical toward sheave 76. In following this path, rope 116 extends across the path it followed in extending downward to the sheave 94, viewed in the axial direction of the sheave 94. The ropes 114 and 116 thus extend upward from sheave 94 in diverging directions and generally in the direction of travel of the crane on the rails 4 and 6.

Acceleration or deceleration, particularly at a rapid rate, by the crane as it travels on the rails 4 and 6 or by the trolley 36 as it travels on the tracks 32 and 34 will result in swaying forces on the lifting beam 54 tending to cause swaying of the lifting beam, load carrying means 60 and any load it may be carrying in the directions of the crane travel or in the directions of the trolley travel. Also, picking up of unbalanced loads or loads requiring the load carrying means 60 to be positioned at an angle, may result in forces tending to cause rotational swaying about a vertical axis. In the case of attempted swaying in the directions of the crane travel on rails 4 and 6, all or at least a part of the swaying will be prevented by friction forces between sheave 90 and ropes 104, 106 and between sheave 94 and ropes 114, 116 which hold the sheaves 90 and 94 from rotating and are generated in response to the swaying force. The friction forces are the result of and are proportional to the tension on the ropes 104, 106 and 114, 116 due to the friction between the ropes and the grooves 124, 126 in each sheave 90 and 94, and the load of the lifting beam, load carrying means, any load carried by the latter, and swaying forces of the lifting beam, load carrying means and any load. For example, in the view of FIG. 3, sway force on the lifting beam 54 to the right will correspondingly apply force on sheave 90 attempting to rotate it to the right. However, the tension of the rope 106 along its paths to the drum 59 and sheave 74 to the left and the friction of rope 106 along its wrapped around engagement area with groove 124 of sheave 90 provides a friction force along the grooves of the sheave 90 which dissipates the energy of the sway force to the right and prevents sway movement to the right or left. If the sway force on the lifting beam 54 is to the left, the tension of rope 104 along its paths to the drum 57 and sheave 72 to the right and the friction of rope 104 with groove 126 of sheave 90 provides a friction force along the grooves of the sheave 90 which dissipates the energy of the sway force and thereby inhibits further sway movement to the left or the right. Since the ropes 104 and 106 wrap around the same single sheave 90 and extend in opposite directions away from the sheave, the combined friction force generated by the two ropes with a single sheave quickly stops swaying movement. Thus, the sway energy is dissipated by friction between the ropes and sheave along the grooves of the sheave rather than by continued significant sway movement until the sway energy is dissipated in the entire hoist system. The ropes 114, 116 and the sheave 94 function in the same manner as ropes 104, 106 and sheave 90 to prevent sway in the directions of the crane travel. Similarly the ropes 104, 114 wrapped around sheave 88 and the ropes 106, 116 wrapped around sheave 92 function in the same manner as ropes 104, 106 and sheave 90 to prevent sway in the directions of the travel of trolley 36. All of the lower sheaves and ropes function as described with reference to sway in either crane or trolley travel directions to prevent rotational sway movement about a vertical axis.

It will be understood that the foregoing description of the present invention is for purposes of illustration only and that the invention is susceptible to a number of modifications or changes, none of which entail any departure from the spirit and scope of the present invention as defined in the hereto appended claims.

What is claimed is:

1. A reeving apparatus for a crane having an overhead frame, winding drum means mounted on the frame, and a lifting beam positioned below the frame and subject to swaying forces and movement transverse to the vertical, comprising:

a plurality of a spaced-apart rotatable lower sheaves affixed to the lifting beam, each of said sheaves having first and second grooves; and rope means affixed to the drum means and overhead frame and wrapped around the sheaves for supporting the lifting beam and load carrying means, the rope means including a plurality of first and second rope means both extending to and wrapped in the same direction around one of the plurality of sheaves respectively in the first and second grooves, each first and second rope means wrapped around one of the sheaves extending to the one sheave from opposite directions relative to the vertical and transverse to the axis of the one sheave for generating friction forces with each one of the sheaves which dissipates the energy of the swaying forces on the lifting beam.

2. The reeving apparatus according to claim 1 wherein each of the plurality of first and second rope means are in friction engagement with a different one the sheaves for generating said friction forces with each said different one of the sheaves.

3. The reeving apparatus according to claim 1 wherein each of plurality of first and second rope means are under tension and generate said friction forces with each one of the sheaves which are proportional to said tension and the coefficient of friction between each of the plurality of first and second rope means and the sheave which they engage.

4. The reeving apparatus according to claim 1, 2 or 3 wherein each of the plurality of first and second rope means are responsive to said swaying forces to produce said friction forces.

5. The reeving apparatus according to claim 1, 2, or 3 wherein each of the plurality of first and second rope means generates said friction forces opposing rotational movement of each one of the sheaves about its axis in response to swaying forces on the sheave.

6. The reeving apparatus according to claim 1, 2 or 3 wherein:

said swaying forces are substantially in horizontal directions, and tend to rotate each of the plurality of sheaves in said horizontal directions; and each of the plurality of first and second rope means generates, with the one sheave about which the first and second plurality of rope means wraps, said friction forces in opposition to said rotation of the one sheave.

7. The reeving apparatus according to claim 3 further comprising:

a plurality of upper spaced-apart rotatable sheaves affixed to the overhead frame; and wherein the winding drum means includes first and second rotatable drums each having first and second opposite ends;

the overhead frame has plurality of anchoring locations; and the first and second rope means of one of the plurality of first and second rope means each extend from a different one of the anchoring locations to said one of the sheaves, thence to a different one of the upper sheaves, thence to the opposite ends of one of the first and second drums.

8. The reeving apparatus according to claim 7 wherein the positions of the upper and lower sheaves, the ends of the first and second drums, and the anchoring locations, are such that the friction forces generated by the lower sheaves and the first and second rope means wrapped around each lower sheave are substantially equal at each lower sheave.

9. The reeving apparatus according to claim 1 wherein:

the first and second rope means are each under tension in their respective directions of extension from said one lower sheave; and the first and second rope means are each in friction engagement along their respective paths of wrap around said one lower sheave whereby said one lower sheave is rotationally held by the tension of the first and second rope means and their friction engagement with said one lower sheave against said swaying forces whereby the swaying forces dissipate their energy in attempting to overcome the holding of the one lower sheave by the first and second rope means.

10. A reeving apparatus for a crane having an overhead frame, a lifting beam positioned below and suspended from the overhead frame and subject to swaying forces and movement transverse to the vertical, load carrying means suspended from the lifting beam, and winding drum means mounted on the overhead frame for raising and lowering the lifting beam, the load carrying means, and any load carried by the latter, comprising:

a plurality of upper spaced-apart rotatable sheaves affixed to the overhead frame;

a plurality of lower spaced-apart rotatable sheaves affixed to the lifting beam, each of said lower sheaves having first and second grooves;

rope means affixed to the drum means and overhead frame and wrapped around the upper and lower sheaves for supporting the lifting beam and load carrying means, the rope means including first and second ropes following separate paths approaching one of the lower sheaves from first and second locations spaced apart transversely to the axis of said one lower sheave and wrapping around said one lower sheave respectively in the first and second grooves in the same rotative direction of said one lower sheave and extending from said one lower sheave to third and fourth locations spaced apart transversely to the axis of said one lower sheave;

the winding drum means includes first and second rotatable drums each having first and second opposite ends and a plurality of rope affixation positions adjacent said ends;

the overhead frame has a plurality of anchoring locations to which the rope means is affixed, each anchoring location being adjacent to one of the ends of one of the drums;

said first and third locations respectively comprise one of the upper sheaves and one of the anchoring locations adjacent the first end of one of the first and second drums; and said second and fourth locations respectively comprise one of the upper sheaves and one of the anchoring locations adjacent the second end of one of the first and second drums.

11. A reeving apparatus for a crane having an overhead frame, a lifting beam positioned below and suspended from the overhead frame and subject to swaying forces and movement transverse to the vertical, load carrying means suspended from the lifting beam, and winding drum means mounted on the overhead frame for raising and lowering the lifting beam, the load carrying means, and any load carried by the latter, comprising:

a plurality of upper spaced-apart rotatable sheaves affixed to the overhead frame;

a plurality of lower spaced-apart rotatable sheaves affixed to the lifting beam, each of said lower sheaves having first and second grooves; and rope means affixed to the drum means and overhead frame and wrapped around the upper and lower sheaves for supporting the lifting beam and load carrying means, the rope means including first and second ropes following separate paths approaching one of the lower sheaves from first and second locations spaced apart transversely to the axis of said one lower sheave and wrapping around said one lower sheave respectively in the first and second grooves in the same rotative direction of said one lower sheave and extending from said one lower sheave to third and fourth locations spaced apart transversely to the axis of said one lower sheave.

12. The reeving apparatus according to claim 11 wherein:

the winding drum means includes first and second rotatable drums each having a first end and an opposite second end;

the overhead frame has a plurality of anchoring locations to which the rope means is affixed; and the first, second, third and fourth locations each comprise one of the first and second rotatable drums, one of the anchoring locations, and one of the plurality of upper sheaves.

13. The reeving apparatus according to claim 12 wherein:

the first and second locations respectively are on the first drum adjacent the first end of the first drum and on the second drum adjacent the first end of the second drum;

first and second ones of the plurality of upper sheaves are respectively positioned adjacent the first end of the first drum and the first end of the second drum; and the third and fourth locations respectively comprise the first and second ones of the plurality of upper sheaves.

14. The reeving apparatus according to claim 11 wherein:

the winding drum means includes first and second rotatable drums each having first and second opposite ends and a plurality of rope affixation positions adjacent said ends;

the overhead frame has a plurality of anchoring locations to which the rope means is affixed, each anchoring location being adjacent to one of the ends of one of the drums;

said first and third locations respectively comprise one of the upper sheaves and one of the anchoring locations adajcent the first end of one of the first and second drums; and said second and fourth locations comprise one of the upper sheaves and one of the anchoring locations adjacent the second end of one of the first and second drums.

15. A reeving apparatus for a crane having an overhead frame, a lifting beam positioned below and suspended from the overhead frame and subject to swaying forces and movement transverse to the vertical, load carrying means suspended from the lifting beam, and winding drum means mounted on the overhead frame for raising and lowering the lifting beam, the load carrying means, and any load carried by the latter, comprising:

a plurality of upper spaced-apart rotatable sheaves affixed to the overhead frame;

a plurality of lower spaced-apart rotatable sheaves affixed to the lifting beam, each of said lower sheaves having first and second grooves;

rope means affixed to the drum means and overhead frame and wrapped around the upper and lower sheaves for supporting the lifting beam and load carrying means, the rope means including first and second ropes following separate paths approaching one of the lower sheaves from first and second locations spaced apart transversely to the axis of said one lower sheave and wrapping around said one lower sheave respectively in the first and second grooves in the same rotative direction of said one lower sheave and extending from said one lower sheave to third and fourth locations spaced apart transversely to the axis of said one lower sheave;

the winding drum means includes first and second rotatable drums each having a first end and an opposite second end;

the overhead frame has a plurality of anchoring locations to which the rope means is affixed; and the first, second, third and fourth locations each comprise one of the first and second rotatable drums, one of the anchoring locations, and one of the plurality of upper sheaves.

16. The reeving apparatus according to claim 15 wherein:

the first and second locations respectively are on the first drum adjacent the first end of the first drum and on the second drum adjacent the first end of the second drum;

first and second ones of the plurality of upper sheaves are respectively positioned adjacent the first end of the first drum and the first end of the second drum; and the third and fourth locations respectively comprise the first and second ones of the plurality of upper sheaves.

17. The reeving apparatus according to claim 15 or 16 wherein:

the first and second drums each have a circumferential area facing away from the other circumferential area; and the first and second ropes respectively extend from a different one of the circumferential areas of the first and second drums to one of the lower sheaves.

18. The reeving apparatus according to claim 17 wherein the first and second drums rotate in opposite directions to raise the lifting beam.

* * * * *